United States Patent [19]

Bixler

[11] Patent Number: 4,823,959

[45] Date of Patent: Apr. 25, 1989

[54] CARRIER FOR BEVERAGE CONTAINERS

[75] Inventor: Kenneth D. Bixler, Lake Forest, Ill.

[73] Assignee: Packaging Corporation of America, Evanston, Ill.

[21] Appl. No.: 154,939

[22] Filed: Feb. 11, 1988

[51] Int. Cl.[4] ..... B65D 71/00

[52] U.S. Cl. ..... 206/562; 206/159; 220/23.8

[58] Field of Search ..... 206/159, 562, 563, 588–590; 220/23.8

[56] References Cited

U.S. PATENT DOCUMENTS

| | | | |
|---|---|---|---|
| D. 197,358 | 1/1964 | DeShazor, Jr. . | |
| D. 238,249 | 12/1975 | Erickson . | |
| D. 242,325 | 11/1976 | Olsen . | |
| D. 248,371 | 7/1978 | Davis . | |
| D. 249,622 | 9/1978 | Vigue . | |
| D. 250,091 | 10/1978 | Jewell . | |
| D. 253,561 | 12/1979 | Vigue . | |
| D. 274,110 | 6/1984 | Vigue . | |
| 1,541,672 | 6/1925 | Tulay . | |
| 2,314,935 | 3/1943 | Gutterman . | |
| 2,766,919 | 10/1956 | Randall . | |
| 3,103,303 | 9/1963 | Lynchey . | |
| 3,140,035 | 7/1964 | Wenzel | 206/562 |
| 3,161,342 | 12/1964 | Wenzel | 206/562 |
| 3,369,724 | 2/1968 | Ettlinger | 206/562 |
| 3,944,109 | 3/1976 | Holz . | |
| 4,053,099 | 10/1977 | Lock | 206/562 |
| 4,288,013 | 9/1981 | Napier | 206/159 |

*Primary Examiner*—Joseph Man-Fu Moy

*Attorney, Agent, or Firm*—Neuman, Williams, Anderson & Olson

[57] ABSTRACT

A carrier for beverage containers is provided which includes a plurality of container-accommodating sections arranged in laterally spaced relation. Each section includes a continuous peripheral rib which delimits an opening to receive a container. The rib comprises an outer flange and an inner flange which are interconnected along corresponding upper edges. The flanges depend divergently from the interconnected upper edges. Each rib is provided with a plurality of relatively spaced shoulders extending into the rib inner flange and forming same into a plurality of flange segements arranged in an endwise circumferentially spaced relation. Each shoulder includes a top portion extending inwardly from the interconnected flange upper edges. Depending from the top portion are opposed side portions, the latter interconnecting the top portion with corresponding ends of adjacent flange segments. A plurality of rib extensions are provided; each of which interconnects portions of the rib outer flanges of adjacent container-accommodating sections and coacts therewith to form a continuous peripheral rim which encompasses all of the container-accommodating sections.

13 Claims, 2 Drawing Sheets

FIG. 7
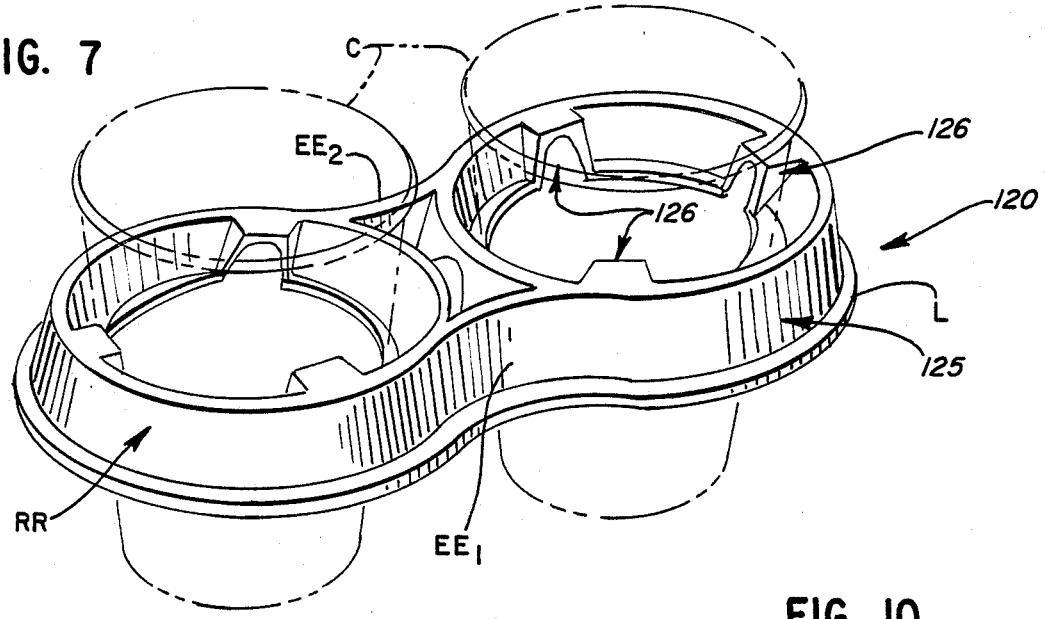
FIG. 10
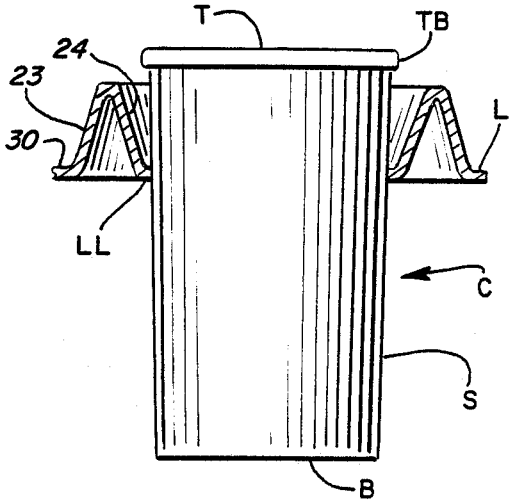
FIG. 8
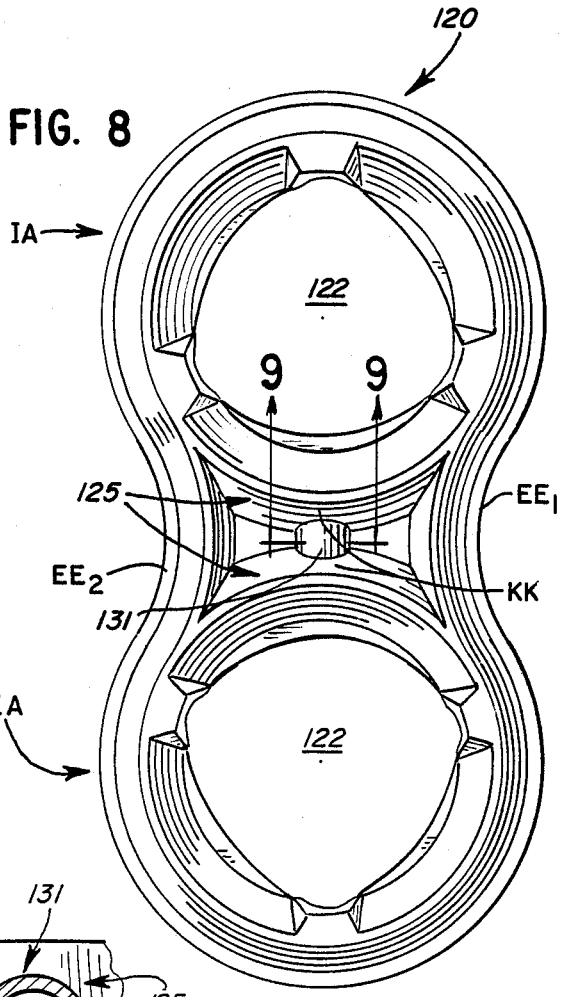
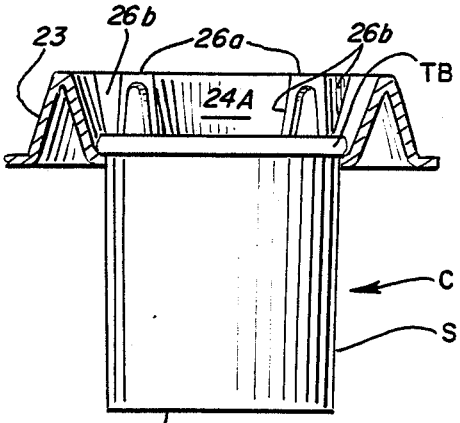
FIG. 11
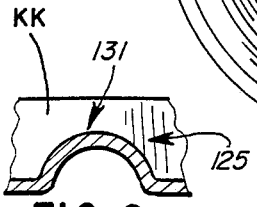
FIG. 9

CARRIER FOR BEVERAGE CONTAINERS

BACKGROUND OF THE INVENTION

With the popularization of fast food establishments, it is important that the customer can readily handle the purchased food and beverage items in a facile, convenient and safe manner. In many such establishments where the purchased items are for carry-out, the clerk will deposit all such items in a paper bag or the like after lids or caps have been secured to the tops of the beverage containers and the food items have been wrapped in suitable sheets of wrapping paper or foil. Notwithstanding the care exercised by the clerk in placing the items in the bag, the beverage containers will oftentimes accidently tip over in the bag causing leakage of the beverage within the bag and deleteriously affecting the palatability of the bagged food items. Leakage becomes a prevalent problem, particularly where the lid or cap is provided with slits to enable the end of a straw to be readily inserted therethrough while the lid or cap remains in place or where the lid or cap is not properly assembled on the container.

Where disposable trays are utilized in lieu of bags for handling such food and beverage items, such trays are frequently awkward to handle, require some setting up by the clerk before use, are inherently weak and susceptible to tearing and bending, are expensive and cannot be readily stacked for storage in a compact bundle, and/or are not capable of properly accommodating beverage containers which vary in size and shape over a wide range.

It has been found to be most convenient and desirable to bag the food items and to accommodate two or more beverage containers in a separate carrier. Not only are the food items (e.g., sandwiches, french fried potatoes, etc.) separated from the beverage items in such a procedure, but a plurality of beverage items can be manually carried simultaneously without difficulty.

Beverages in most fast food establishments, are normally sold in various sizes (e.g., small, medium and large or jumbo) of containers. Such containers are usually formed of treated paper stock or foam plastic material and have tapered rounded sides and flat bottoms. The open upper end of each container is normally defined by a small, outwardly projcting bead. The various size containers generally have substantially the same configuration but vary primarily in the height or width dimension.

SUMMARY OF THE INVENTION

Thus, it is an object of the invention to provide a carrier for a plurality of beverage containers which is of unitary, preformed containrs, is of simple, inexpensive design, can accommodate containers which vary in size and shape over a wide range, and is comfortable and easy to manually handle.

It is a further object to provide a carrier which can be readily handled with one hand even when the carrier is loaded with filled containers.

It is a still further object to provide a carrier which is insulted from both cold and heat and thus, enables containers of hot and cold beverages to be simultaneously carried by a single carrier.

It is a still further object to provide a carrier which will readily nest with like carriers so as to form a compact bundle or stack suitable for storage or bulk shipment.

Lastly, it is a further object to provide a carrier which allows the containers to be readily assembled therein or disassembled therefrom with a simple, facile manual manipulation.

Further and additional objects will appear from the description, accompanying drawings and appended claims.

In accordance with one embodiment of the invention, an improved, disposable carrier for a plurality of beverage containers is provided which may be formed of inexpensive molded pulp or suitable plastic material. The carrier includes a plurality of laterally spaced container—accommodating sections. Each section is provided with a continuous peripheral rib, the latter having inner and outer flanges interconnected along corresponding upper edges. The flanges depend divergently from the interconnected upper edges. The rib inner flange is provided with a plurality of relatively spaced shoulders. The shoulders effect separation of the rib inner flange into a plurality of flange segments arranged in circumferentially spaced relation. Each shoulder includes a top portion which extends inwardly from the interconnection of the flange upper edges. Depending from opposite sides of the top portion are side portions, each of which interconnects the top portion to an end of an adjacent flange semgent. A plurality of rib extensions are provided which interconnect portions of the rib outer flanges of adjacent container-accommodating sections and coact therewith so as to form a continuous peripheral rim which encompasses all of the laterally spaced container-accommodating sections.

DESCRIPTION

For a more complete understanding of the invention reference is made to the drawings wherein.

FIG. 7 is a perpsective top view of a second embodiment of the improved carrier showing in phantom lines two beverage containers accommodated therein.

FIG. 8 is a top plan view of the carrier of FIG. 7 without the beverage containers.

FIG. 9 is an enlarged, fragmentary sectional view taken along section line 9—9 of FIG. 8.

FIG. 10 is an enlarged, fragmentary sectional view taken along line 10—10 of FIG. 1 and showing the carrier accommodating a large, or jumbo, size beverage container.

FIG. 11 is similar to FIG. 10, but showing a small size beverage container being accommodated by the improved carrier.

Figure 1:
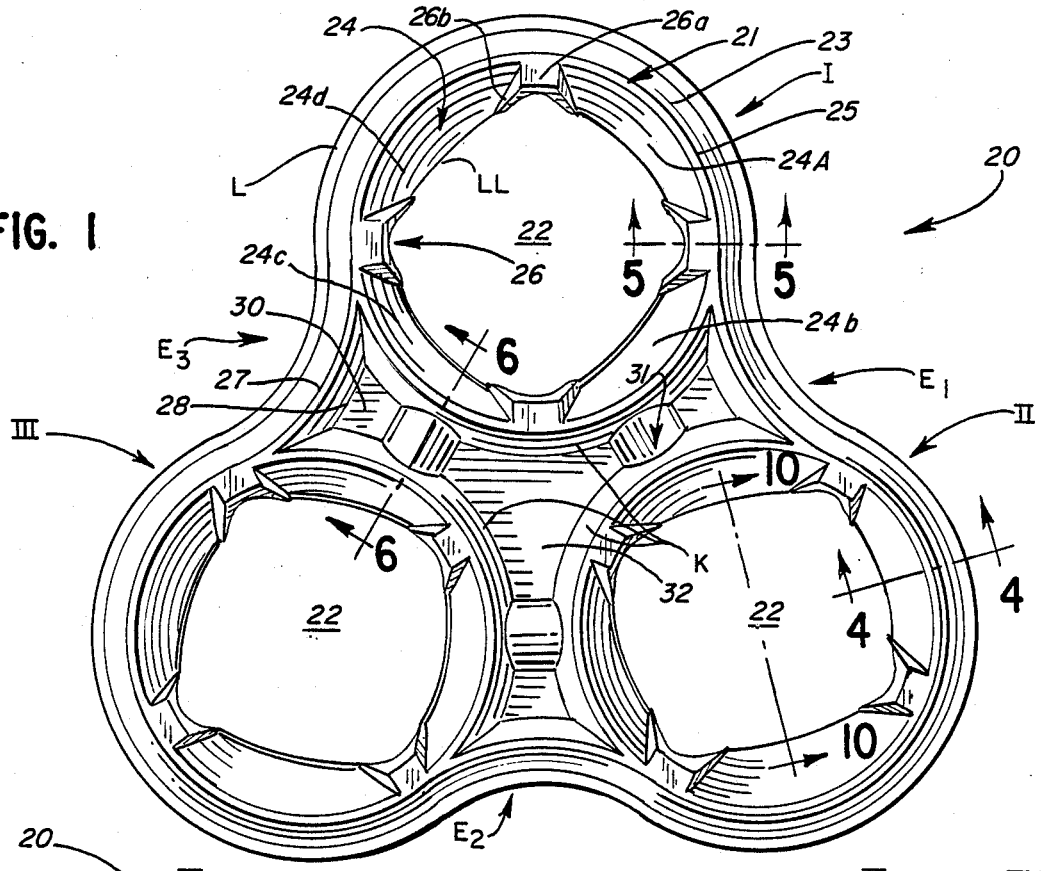
FIG. 1 is a top plan view of a preferred embodiment of the improved carrier capable of simultaneously accommodating three beverage containers, not shown.
Figure 2:
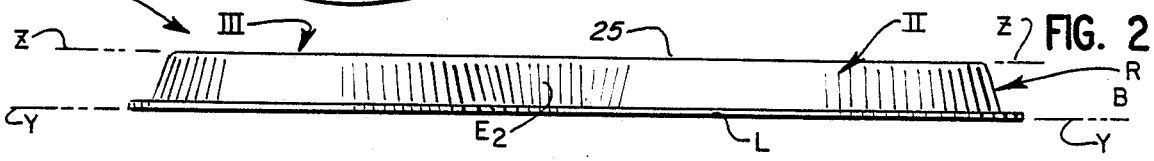
FIG. 2 is a side elevational view of the carrier of FIG. 1.
Figure 3:
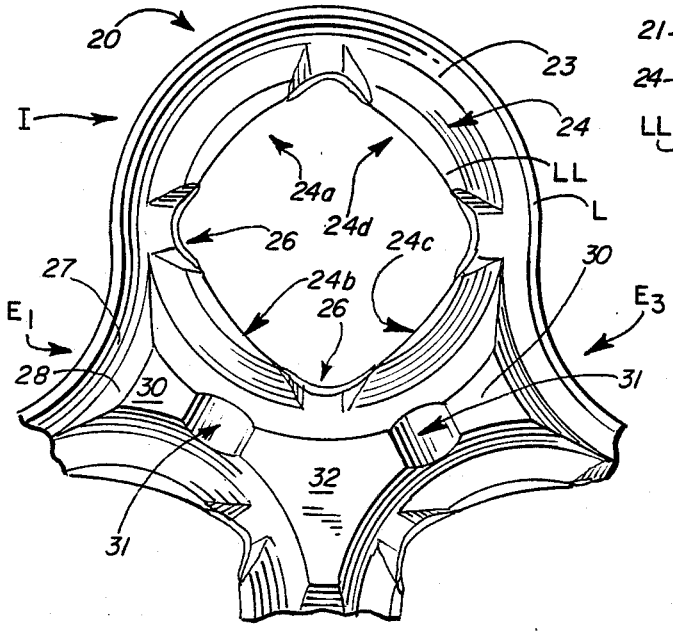
FIG. 3 is a fragmentary bottom view of the carrier of FIG. 1.

Referring now to the drawings and more particularly to FIGS. 1–3 a preferred embodiment of the improved carrier 20 is shown which is particularly suitable for use in fast-food or carry-out food establishments and is capable of simultaneously accommodating at least three beverage containers. C. The containers may vary in size and shape and are normally classified as either a small (9 oz.), medium (12 oz.) or large or jumbo (16 oz.) size. Such containers are of conventional design and each has a frusto-conical, or curved tapered, side wall, a flat or slightly concave bottom B, and an open top T usually encompassed by a small, outwardly protruding, peripheral bead T', see FIGS. 9 and 10. The container may, if desired, include a lid or cap of conventional design, not shown, which will close off the top T when assembled thereon.

The carrier 20, is preferably formed of a molded pulp or a form plastic material that is inexpensive, disposable, heat and cold resistant, and yet is capable of providing adequate strength and rigidity for simultaneously supporting a plurality of containers when filled with either a hot or cold beverage.

Figure 4:
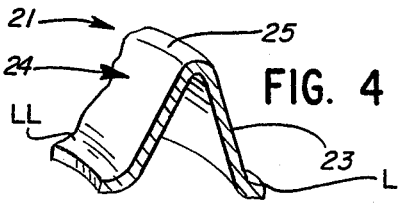
FIGS. 4–6 are enlarged, fragmentary, perspective sectional views taken, respectively, along section lines 4—4, 5—5, and 6—6 of FIG. 1.

As shown in FIG. 1, carrier 20 is provided with three container-accommodating sections I, II and III of like configuration which are symmetrically arranged in laterally spaced relation about a central transverse axis L see FIGS. 1 and 2. Each section includes a continuous, upstanding, peripheral rib 21 which delimits an opening 22 in which a container C is inserted, as will be described more fully hereinafter. Each rib 21, as seen in FIG. 4, includes an outer flange 23 and an inner flange 24. The flanges have corresponding upper edges interconnected at 25. The outer flange 23 extends upwardly and outwardly from the interconnection 25 and terminates in a laterally offset outwardly extending lip L. The inner flange 24, on the other hand, extends downwardly and inwardly from the interconnection 25 and terminates in an inwardly extending offset ledge LL, see FIGS. 4 and 5.

Figure 5:
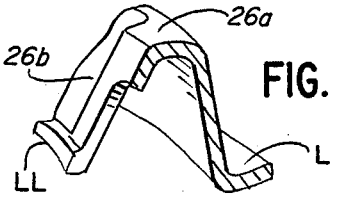
Figure 6:
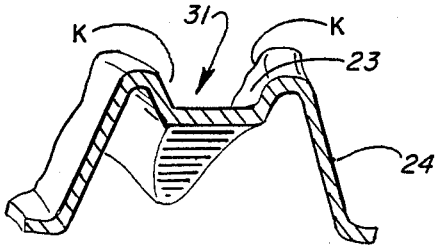

The inner flange 24 is interrupted by a plurality of annularly spaced shoulders 26, see FIGS. 1 and 5, forming flange 24 into a plurality of flange segments 24A, 24B, 24C and 24D which are disposed in endwise, circumferentially spaced relation, see FIG. 3. Each shoulder 26 is provided with a substantially planar top portion **26*a* which projects laterally inwardly from the interconnection 25. Depending from the top portion are opposing side portions 26*b*, each of which terminates at an adjacent end of a corresponding flange segment. The inner edges of the top and side portions of the shoulders and the ledges LL of the flange semgnets 24A–D coact to define the perimeter of opening 22**.

In some instances where the container, accommodated in an opening 22, has a relatively steeply tapered side and a large outwardly projecting bead T', the underside of such bead may engage and be supported by either the shoulder top portions **26*a* or the inwardly projecting ledge LL formed on the inner flange 24**.

As seen in FIG. 1, corresponding portions of the rib outer flanges 23 of adjacent container-accommodating sections I–III, I–II and II–III are interconnected by rib extensions $E_1$, $E_2$ and $E_3$ so that a continuous peripheral rim R encompasses all of the sections I, II and III and defines the marginal configuration of the container. Each rib extension is of like configuration and includes a pair of depending divergent flanges, one flange 27 being the outer flange and a second flange 28 being the inner flange. The flanges have similar curved or concave configurations. The lower edge of the extension outer flange 27 terminates in a laterally offset lip **27*a*. The ends of outer flange 27 and offset lip 27*a* are tangentially interconnected to the corresponding outer flanges 23 and lips L of the ribs 21** of adjacent sections I, II or III.

The lower edge of the extension inner flange 28 terminates in a narrow, inwardly projecting quasi-triangular segment 30. The underside of each segment 30 is substantially disposed within a plane Y (FIG. 2) defined by the underside of the peripheral lips L and **27*a*. As seen in FIGS. 1 and 3, each extension inner flange 28 is angularly disposed and connected to the top portions of the rib flanges 23** of adjacent container-accommodating sections which are disposed within the area encompassed by the continuous peripheral rim R.

The portions of the rib flange 23 of adjacent sections I, II and III which are in closest proximity to each other are interconnected by a transversely extending, reinforcing strut 31. Each strut has a like inverted U-shaped cross-sectional configuration, see FIG. 9. The struts 31 in carrier 20 are radially spaced a like amount from the transverse central axis and of the carrier.

The struts 31 and the portions K of the sections I–III proximate the center axis L coact with one another to form a quasi-triangular center segment 32 having an area greater than any segment 30. The segment 32 is recessed from a plane Z (FIG. 2) defined by the rib interconnections 25 and spans the distance between the rib portions K of the sections I–III. The underside of segment 32 is substantially disposed without plane Y.

The concavity of each rib extension $E_1$, $E_2$, or $E_3$ enables a thumb and index finger of a hand of the person carrying the carrier 20 to be positioned in relatively close proximity to center segment 32; thus, providing greater balance and stability, when carrying the fully-loaded carrier 20 with one hand. When the carrier is being carried by one hand, the lip **27*a* of one extension $E_1$, $E_2$ or $E_3$ is cradeled between the thum and forefinger so that the thumb hooks inwardly over the top of the extension and the tip of the thumb projects downwardly towards segment 30. Simultaneously therewith the forefinger projects inwardly towards the center axis L and subtends a part of center segment 32**. Thus, the carrier may be tightly grasped between the thumb and forefinger.

Because the struts 31 are uniformly spaced from the center axis, the sections are effectively reinforced by one another against forces attempting to cause bending or sagging of an individual section. Furthermore, by reasons of the concavity of the rib extensions, the support from the thumb and forefinger is applied in close proximity to each of the sections thereby minimizing the bending moment arm for each section.

FIGS. 7–9 disclose a second embodiment 120 of the improved carrier which differs from carrier 20 in that it only includes two container—accommodating sections IA and IIA. The sections of the carrier 120 are of substantially the same configuration as sections I–III, except as noted in FIG. 8, sections IA and IIA have only three shoulders 126 rather than four as shown in FIG. 1. The number of shoulders per section may vary from that shown, if desired.

A single strut 131 is provided in carrier 120 which is aligned with the center axes of the openings 122 formed in the container-accommodating sections IA and IIA and span the distance between the portion KK of flanges 125 of sections IA and IIA which are closest proximity to one another, see FIG. 8. The strut 131 is centrally disposed between rib extensions $EE_1$ and $EE_2$, the latter interconnecting corresponding of the ribs 121 formed in the container-accommodating sections IA and IIA. The rib extensions $EE_1$ and $EE_2$ cooperate with the ribs 121 of sections IA and IIA to form a continuous peripheral rim RR. The rim RR provides reinforcement for the carrier 120 thereby preventing sagging or distortion of the carrier when it is loaded with filled containers. Rib extensions $EE_1$, $EE_2$, $E_1$, $E_2$ and $E_3$ are of substantially the same configuration and function in the same manner as previously described.

While the openings 22 and 122 have a substantially circular configuration and are particularly suitable for accommodating containers having sides which have a frusto-conical configuration, they are not intended to be limited thereto, but said openings may have a triangular, octagonal or square configuration. While the carrier is formed from an inexpensive material it is nevertheless possessed of sufficient strength to readily and safely accommodate at least three full jumbo size containers. Further the improved carrier is of heat/cold resistant material thereby allowing containers containing hot and cold beverages to be simultaneously accommodated within the carrier without adversely affecting each other or rendering the carrier uncomfortable to manually carry.

I claim:

1. A device for manually carrying a plurality of beverage containers, the latter having downwardly tapered side walls, said device being of unitary construction and comprising a plurality of container-accommodating sections arranged in laterally spaced relation, each section including a continuous peripheral rib delimiting an opening for removably accommodating a portion of a container side wall, each rib being provided with an outer flange and an inner flange, said flanges having corresponding upper edges interconnected, said outer flange extending downwardly and outwardly from the interconnected upper edges and said inner flange extending downwardly and inwardly from said interconnected upper edges, said rib having a plurality of relatively spaced shoulders extending into the inner flange and forming same into a plurality of flange segments arranged in endwise circumferentially spaced relation, each shoulder including a top portion extending inwardly from the interconnected flange upper edges, and opposed side portions depending from said top portion and interconnecting said top portion with corresponding ends of adjacent flange segments, and a plurality of rib extensions, each extension interconnecting portions of the rib outer flanges of adjacent container-accommodating sections and coacting therewith to form a continuous peripheral rim encompassing the plurality of laterally spaced container-accommodating sections.

2. The device of claim 1 wherein said device is formed of molded pulp material.

3. The device of claim 1 wherein each rib, except in the vicinity of said shoulders, has an inverted substantially V-shaped cross-sectional configuration.

4. The device of claim 3 wherein each rib extension has an inverted substantially V-shaped cross-sectional configuration.

5. The device of claim 1 wherein portions of the peripheral rim in the vicinity of said rib extensions have a concave configuration.

6. The device of claim 1 wherein proximate portions of the ribs of adjacent container-accommodating sections are interconnected by at least one reinforcing strut.

7. The device of claim 6 wherein one end of a strut terminates at the outer flange of the rib of one adjacent-container accommodating section and a second end of the strut terminates at the outer flange of the rib of the other adjacent container-accommodating section.

8. The device or claim 6 wherein the strut has an inverted substantially U-shaped cross-sectional configuration.

9. The device of claim 1 wherein three container-accommodating sections are provided, said sections being substantially symmetrically arranged relative to a transverse central axis.

10. The device of claim 9 wherein the central axis intersects a recessed center surface, the latter interconnecting corresponding portions of the rib outer flanges of the three container-accommodating sections.

11. The device of claim 10 wherein the center surface has a substantially planar, exposed underside.

12. The device of claim 1 wherein the peripheral rim includes a continuous offset lip extending from a lower edge of each rib outer flange defining the rim and from a lower edge of an outer flange defining each rib extension.

13. The device of claim 1 wherein each rib inner flange terminates in an offset lower ledge, said ledge forming a perimetric segment of the section opening.

* * * * *

UNITED STATES PATENT AND TRADEMARK OFFICE

CERTIFICATE OF CORRECTION

PATENT NO. : 4,823,959

DATED : April 25, 1989

INVENTOR(S) : Kenneth D. Bixler

It is certified that error appears in the above-identified patent and that said Letters Patent is hereby corrected as shown below:

Col. 1, line 56, "containrs" should be --construction-- line 64, "insulted" should be --insulated--

Col. 2, line 28, "semgent" should be --segment-- line 67, delete "." before C.

Col. 3, line 26, "upwardly" should be --downwardly-- line 45, "semgnets" should be --segments-- line 58, "container" should be --carrier--

Col. 4, line 7, delete "top"

line 25, "without" should be --within-- line 33, "cradeled" should be --cradled-- line 33, "thum" should be -- thumb -- line 45, "reasons" should be --reason-- line 62, insert "in" before "closest"

UNITED STATES PATENT AND TRADEMARK OFFICE

CERTIFICATE OF CORRECTION

PATENT NO. : 4,823,959

DATED : April 25, 1989

INVENTOR(S) : Kenneth D. Bixler

It is certified that error appears in the above-identified patent and that said Letters Patent is hereby corrected as shown below:

Col. 6, claim 8, first line, change "or" to -- of --.

Signed and Sealed this

Seventh Day of November, 1989

*Attest:*

JEFFREY M. SAMUELS

*Attesting Officer* *Acting Commissioner of Patents and Trademarks*